US007575416B2

(12) United States Patent
Funk et al.

(10) Patent No.: US 7,575,416 B2
(45) Date of Patent: Aug. 18, 2009

(54) ROTOR ASSEMBLY FOR A ROTARY MACHINE

(75) Inventors: Stanley J. Funk, New Britain, CT (US); Wieslaw A. Chlus, Wethersfield, CT (US)

(73) Assignee: United Technologies Corporation, Hartford, CT (US)

( * ) Notice: Subject to any disclaimer, the term of this patent is extended or adjusted under 35 U.S.C. 154(b) by 435 days.

(21) Appl. No.: 11/437,189

(22) Filed: May 18, 2006

(65) Prior Publication Data

US 2007/0269315 A1 Nov. 22, 2007

(51) Int. Cl.
*F01D 5/30* (2006.01)

(52) U.S. Cl. ..... 416/193 A; 416/219 R; 416/239

(58) Field of Classification Search ..... 416/96 R, 416/193 A, 206, 219 R, 239; 415/115, 119
See application file for complete search history.

(56) References Cited

U.S. PATENT DOCUMENTS

| | | | | |
|---|---|---|---|---|
| 2,912,223 | A * | 11/1959 | Hull, Jr. | 416/221 |
| 3,834,831 | A * | 9/1974 | Mitchell | 416/95 |
| 5,253,810 | A * | 10/1993 | Maltby et al. | 239/397.5 |
| 5,524,846 | A * | 6/1996 | Shine et al. | 244/53 R |
| 7,090,466 | B2 * | 8/2006 | Honkomp et al. | 416/193 A |
| 2004/0062652 | A1 * | 4/2004 | Grant et al. | 416/220 R |
| 2006/0110255 | A1 * | 5/2006 | Itzel et al. | 416/193 A |
| 2006/0177312 | A1 * | 8/2006 | Tomita et al. | 416/193 A |

* cited by examiner

*Primary Examiner*—Edward Look
*Assistant Examiner*—Aaron R Eastman
(74) *Attorney, Agent, or Firm*—Gene D. Fleischhauer

(57) ABSTRACT

A rotor assembly having a seal member in the root section of a rotor blade is disclosed. Various construction details are developed for blocking the flow of gases between adjacent rotor blades. In one detailed embodiment, a deformable seal member formed of a high temperature material is disposed between the root sections of adjacent rotor blades and engages the blades under operative conditions.

13 Claims, 6 Drawing Sheets

ROTOR ASSEMBLY FOR A ROTARY MACHINE

BACKGROUND OF THE INVENTION

This invention relates to rotor assemblies of the type used in rotary machines, such as gas turbine engines, that have rotor blades. More particularly, this invention relates to structure for blocking the flow of gases between the root sections of adjacent rotor blades.

Axial flow gas turbine engines for industrial purposes and for propelling aircraft typically have a compression section, a combustion section and a turbine section disposed about an axis of rotation. An annular flow path for working medium gases extends axially through the sections of the engine. The gases are compressed in the compression section. Energy is added to the gases in the combustion section. The hot working medium gases are expanded through the turbine section.

In the turbine section, the rotor assembly has a rotor disk and rotor blades that extend outwardly from the rotor disk. The rotor blades extend across the flowpath for working medium gases. Each rotor blade has an airfoil which adapts the rotor assembly to interact with the working medium gases. The rotor blades receive work from gases through the airfoils and drive the rotor disk about the axis of rotation.

The rotor disk is adapted by a plurality of axially extending slots to receive the rotor blades. The rotor blades each have a root section which adapts the rotor blade to engage an associated slot in the rotor disk. Tolerance variations between the root section and the axially extending slot under operative conditions allow for a small amount of circumferential movement or "rocking" of the rotor blades in the slot during assembly and under operative conditions. In addition, assembly requirements, tolerance variations and the need to accommodate thermal growth of between the adjacent root sections requires leaving an opening or circumferential gap G between the adjacent root sections. The gap G is in flow communication with the working medium flowpath and provides a leak path for working medium gases to leave the flowpath and leak around the airfoils. This leakage reduces the efficiency of the engine.

In some stages of the rotor section, the rotor blades are cooled to reduce thermal stresses in the rotor blades and to keep the temperature of the rotor blades within acceptable limits. Reducing the stresses and ensuring the temperatures are not excessive provides the rotor blade with a satisfactory structural integrity and fatigue life.

Cooling air is typically flowed for this purpose at a higher pressure than the working medium gases to passages in the root section. The cooling air is then flowed from the root section through other sections of the rotor blade, such as the airfoil and platforms, and discharged into the working medium flow path to provide cooling to the rotor blades. In such cooled rotor blades, the gap G provides a leak path for the cooling air from the root section into the working medium flowpath which also reduces the efficiency of the turbine.

Accordingly, scientists and engineers working under the direction of Applicants' assignee have sought to develop effective sealing constructions for the root sections of rotor blades. One approach to a sealing construction is discussed below with reference to FIG. 4 and FIG. 4A.

BRIEF SUMMARY OF THE INVENTION

According to the present invention, a rotor assembly having a pair of rotor blades separated by a circumferential gap G includes a deformable, resilient seal member formed of a high temperature material which is disposed between the root sections of adjacent rotor blades, which engages each of the rotor blades and which is resiliently compressed by the rotor blades such that the seal member extends across the circumferential gap G and exerts a sealing force against each of the rotor blades as the seal member circumferentially urges the first rotor blades away from each other.

According to one embodiment of the present invention, the rotor assembly further includes a second pair of rotor blades flanking the first pair of rotor blades and includes a second seal member between each flanking rotor blade and its adjacent rotor blade, the second seal members urging the first pair of rotor blades toward each other and against the first seal member while the sealing force of the first seal member acting against and through the first pair of rotor blades urges the second seal member against the second pair of rotor blades.

According to one embodiment of the present invention, a first rotor blade has a first circumferentially facing surface and the adjacent second rotor blade has a second circumferentially facing surface, the surfaces being spaced by the circumferential gap G, and at least one of the first rotor blades has a way for receiving the seal member, such as a seal channel, in which the seal member is disposed, and for trapping the seal member, the seal member having a circumferential width Wu in the uninstalled condition that is greater than the width Wi in the installed condition such that the seal member extends circumferentially past the first surface of the first rotor blade by a distance G' prior to installation of the second rotor blade by a distance that is greater than the distance G.

The term "seal channel" refers to an opening having a channel-like form that provides a way for receiving the seal member. The seal channel may be bounded in part by sidewalls that are continuous or a sidewall that is formed of sidewall segments.

According to one detailed embodiment of the present invention, the rotor blade includes a root section having a rotor blade root for engaging a rotor disk, a neck extending radially outwardly toward the airfoil region wherein the seal channel extends in a generally radial direction in the neck of the rotor blade between two sidewalls which extend away from the first surface into the rotor blade and are inwardly convergent, such that the seal member in the installed condition engages each of the sidewalls and the surface of the adjacent rotor blade for blocking leakage of the working medium gases between the necks under operative conditions and for damping vibrations in the rotor blades.

A primary feature of the present invention is a seal member which is resiliently deformable in the installed condition. Another feature is the coefficient of thermal expansion of the seal member and the rotor blades which causes the sealing force to increase under operative conditions. Still another feature in one embodiment is the cross-sectional shape of the seal member which permits the seal member to resiliently engage adjacent surfaces on the root section of adjacent rotor blades. In one embodiment, the seal member has an annular wall and generally cylindrical in cross-sectional shape. In one particular embodiment, the seal member has a C-shaped cross-sectional shape and the spring properties of the C-shaped cross-sectional seal member permit the seal member to be compressed during installation. Another feature is a seal channel which is bounded in the rotor blade by a first sidewall, end walls, and a second sidewall at the ends of the first sidewall. In one particular embodiment, the second sidewall extends for the entire length of the first sidewall.

A primary advantage of the present invention is the efficiency of the rotary machine which results from blocking the flow of unwanted gases between the root section of adjacent rotor blades with a resilient seal member. Under operative conditions, the seal member remains in engagement with the adjacent rotor blades as the rotor blades rock or move outwardly in response to operative forces and thermal expansion. Another advantage is the coulomb damping of the rotor assembly from friction which results from the sealing force of the seal member pressing against adjacent rotor blades as the rotor blades move with respect to each other and the seal member under operative conditions. Still another advantage is the durability of the rotor assembly which results from decreasing vibrational stresses in the rotor blades by damping the vibration of the rotor blades. Still another advantage is the durability of the seal member which results from accommodating thermal expansion of the adjacent rotor blades without permanently deforming or being crushed by movement of the rotor blades under operative conditions.

The foregoing features and advantages of the present invention will become more apparent in light of the following detailed description of the invention and the accompanying drawings.

DETAILED DESCRIPTION OF THE INVENTION

Figure 1:
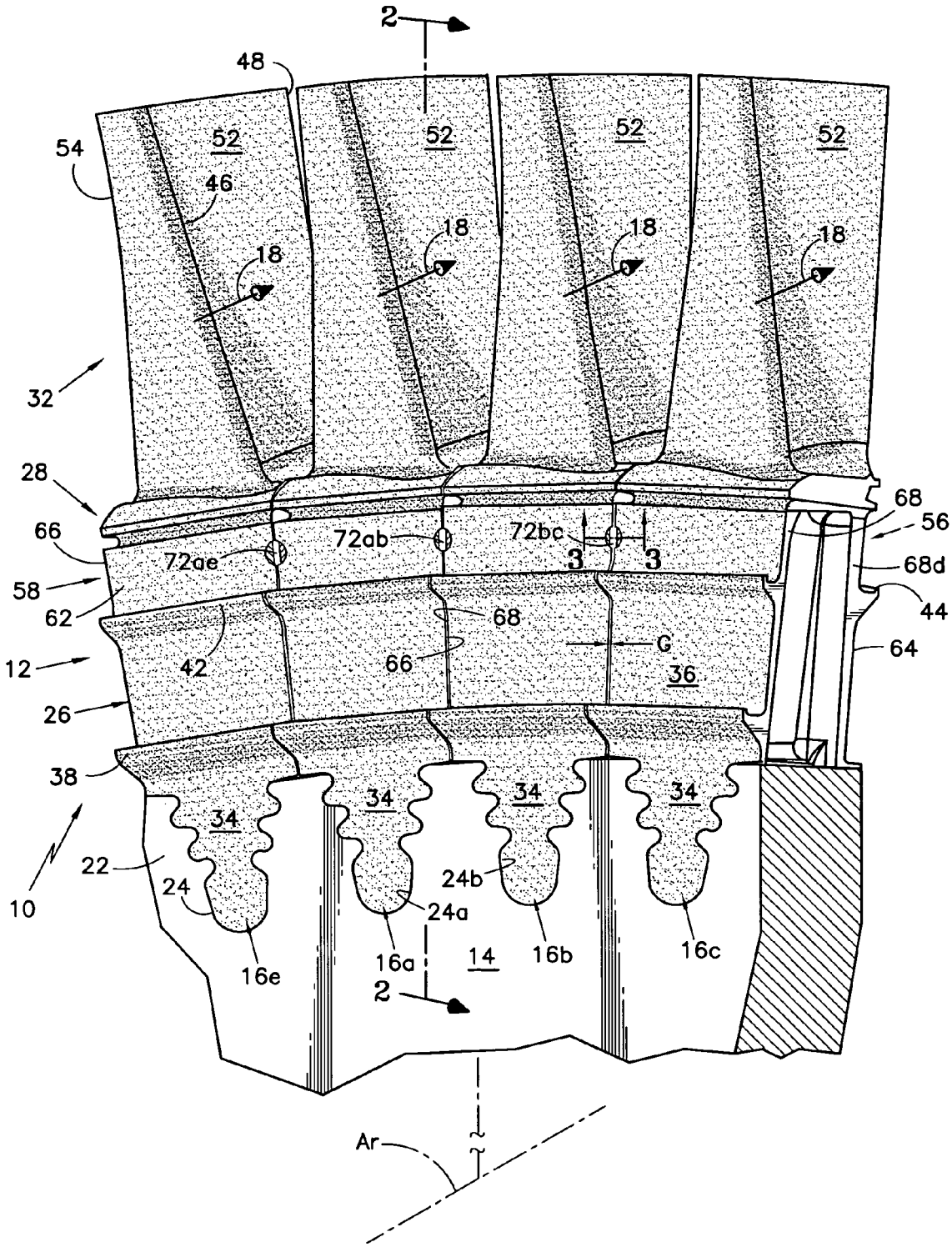
FIG. 1 is a schematic, perspective view partially broken away to show a portion of a rotor assembly for gas turbine engine which includes a rotor disk, and a plurality of rotor blades.

FIG. 1 shows a portion of a gas turbine engine embodiment of a rotary machine 10. More particularly, FIG. 1 is a schematic, perspective view partially broken away to show a portion of a rotor assembly 12. The rotor assembly extends circumferentially about an axis of rotation Ar. The rotor assembly includes a rotor disk 14 and an array of rotor blades 16, as represented by the plurality of rotor blades 16*a*, 16*b*, 16*c*, 16*e*. A flow path 18 for working medium gases extends axially through the rotor blades of the rotor assembly.

The rotor disk 14 includes a rim 22 having a plurality of axially oriented slots, as represented by the fir tree slots 24, which adapt the rotor disk to receive the array of rotor blades 16. Each rotor blade has a root section 26, a platform section 28 and an airfoil section 32. The airfoil section extends outwardly with respect to the root section into the working medium flow path 18.

The root section 26 has a rotor blade root 34 for engaging a corresponding slot 24 in the rotor disk 14. A neck 36 extends radially outwardly from the rotor blade root. The neck extends toward the airfoil section 32 from the rotor blade root 34 to the platform section 28. The neck has segments of a circumferentially extending seal land, as represented by the seal land segments 38, 42, 44. The seal land segments extend circumferentially and axially with respect to the axis of rotation Ar.

Each airfoil section 32 has a leading edge 46 and a trailing edge 48. A pressure sidewall 52 and a suction sidewall 54 extend from the leading edge to the trailing edge. The rotor blade is commonly described as having a pressure side 56 and a suction side 58 in referring to those portions of the rotor blade on the side nearest the pressure sidewall and nearest the suction sidewall. For purposes of description, each part of the rotor blade has a pressure side and a suction side. Similarly, the rotor assembly (and therefore each part of the rotor assembly) has an upstream end 62 and a downstream end 64. The upstream end and the downstream end of the rotor blade are also commonly referred to as the leading edge and trailing edge of the rotor blade.

Each rotor blade 16 at (that is, near) the upstream end 62 has a first surface 66 which extends in the neck 36 and which faces circumferentially and a second surface 68 which extends in the neck and which faces circumferentially. The first surface 66 of one of the rotor blades, such as the rotor blade 16*a*, is spaced from the associated second surface 68 on the adjacent rotor blade 16*b* leaving a circumferential gap G therebetween. Thus, the root section of each rotor blade is separated from the adjacent rotor blade by a gap G which varies under operative conditions.

As shown in FIG. 1, portions of the upstream end 62 of the rotor blades 16*a*, 16*b*, 16*c*, 16*e* are broken away to show resilient seal members 72, as represented by the seal members 72*ab*, 72*bc*, 72*ae*. The resilient seal members are disposed between the root sections 26 of the adjacent rotor blades 16. The array of rotor blades 16 includes a first pair of rotor blades 16*a*, 16*b*. As discussed in more detail below with respect to FIG. 3, the deformable seal member 72*ab* engages each of the rotor blades 16*a*, 16*b* and is resiliently compressed by the rotor blades 16*a*, 16*b*. As a result, the seal member 72*ab* exerts a sealing force against each of the rotor blades 16*a*, 16*b* while circumferentially urging the first rotor blades 16*a*, 16*b* away from each other under operative conditions.

The array of rotor blades 16 of the rotor assembly 12 also includes the second pair of rotor blades 16*c*, 16*e* that flank the first pair of rotor blades 16*a*, 16*b*. A second seal member, as represented by the seal members 72*bc*, 72*ae*, is disposed between each flanking rotor blade 16*c*, 16*e* and its adjacent rotor blade 16*b*, 16*a* from the first pair of rotor blades. Thus, the second seal member 72*ae* is between the rotor blades 16*a*, 16*e* and the second seal member 72*bc* is between the rotor blades 16*b*, 16*c*. With this configuration, the second seal members 72*bc*, 72*ae* of the second or flanking pair of rotor blades urge the first pair of rotor blades 16*a*, 16*b* toward each other and against the first seal member 72*ab*. The sealing force from the first seal member 72*ab* acts against and through the rotor blades 16*a*, 16*b* to urge the second seal members 72*bc*, 72*ae* against the second pair of rotor blades 16*c*, 16*e*.

Figure 2:
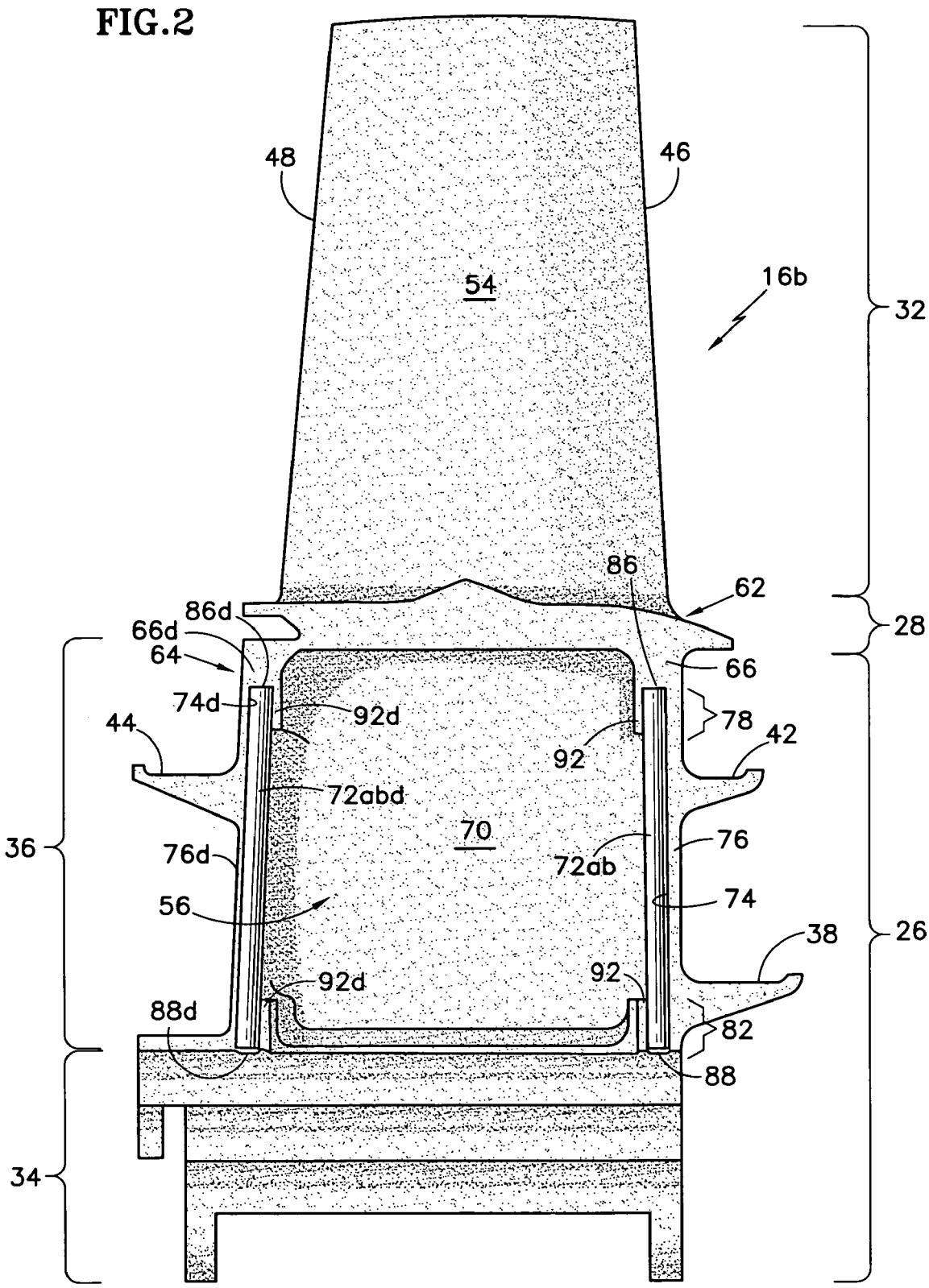
FIG. 2 is a side elevation view of the rotor assembly shown in FIG. 1 taken along the lines 2-2 and is broken away to show a side view of the rotor blade and seal members at the upstream end and downstream end of the rotor blade.

FIG. 2 is a side elevation view of the rotor assembly 12 taken along the lines 2-2 of FIG. 1. The side elevation view is broken away to show the rotor blade 16*b* and, more particularly, the upstream end 62 and downstream end 64 of the rotor blade 16*b*. The upstream end 62 of the rotor blade has the first surface 66 which is shown in FIG. 2. The upstream end also has the second surface 68 (not shown in FIG. 2) as shown for the rotor blade 16*c* in FIG. 1.

The downstream end 64 of the rotor blade 16*b* has structural elements that are similar to the upstream end 62. The same numerical reference indicia are used for those structural elements at the downstream end that are similar to structural elements at the upstream end. In addition, the reference indicia for these elements at the downstream end include the letter "d." For example, the downstream end has a downstream first surface 66*d* which is similar to the first surface 66 at the upstream end. The resilient seal member 72*ab* is at the upstream end. The rotor blade has a seal member 72*abd* at the downstream end.

As shown in FIG. 2, the pressure side 56 of the rotor blade 16*b* extends in a generally radial direction. An interblade chamber 70 is bounded by the root sections 26 and platform sections 28 on the rotor blades 16*a*, 16*b*. A seal channel 74 on the pressure side adapts the upstream end 62 in the neck to receive the seal member 72*ab* by providing a way or opening for the seal member. Similarly, a seal channel 74*d* adapts the downstream end 64 to receive the seal member 72*abd*.

Figure 3:
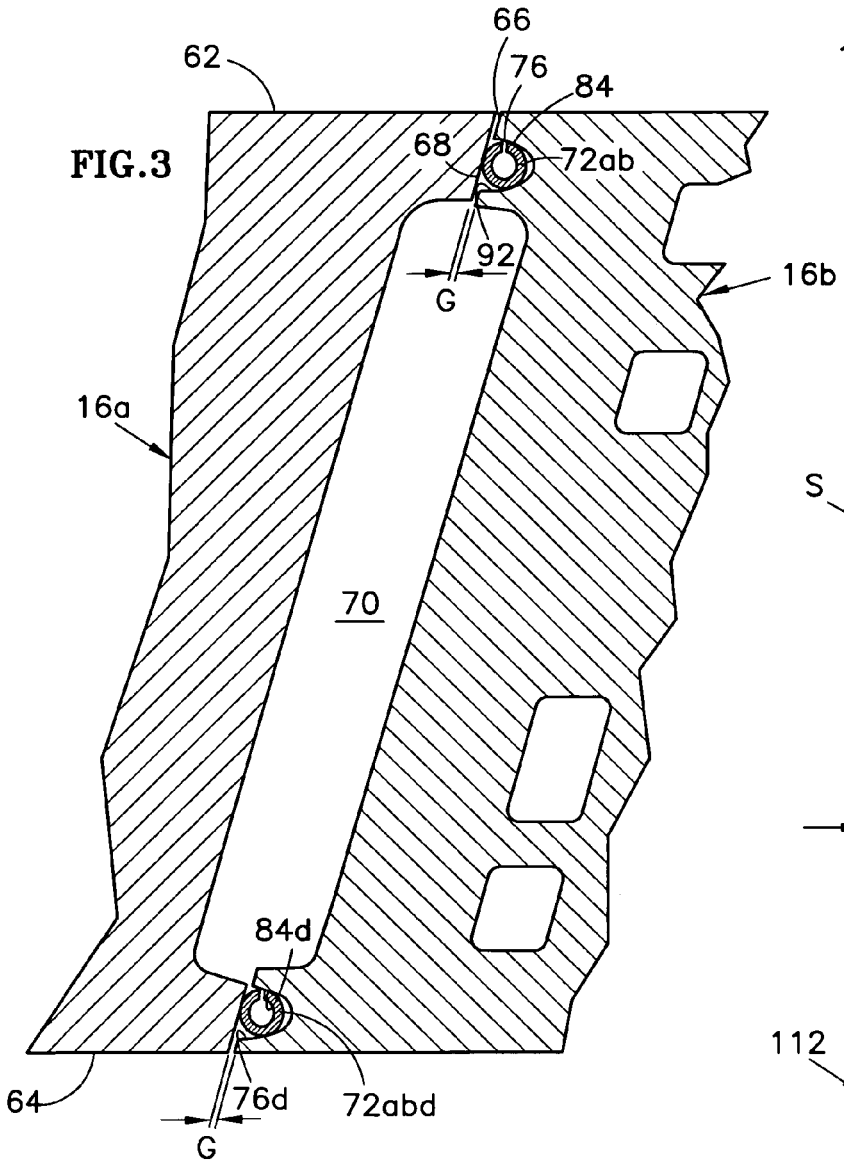
FIG. 3 is a cross-sectional view taken along the lines 3-3 of FIG. 1 and broken away to show adjacent portions of a first pair of rotor blades and a chamber therebetween which receives cooling air under operative conditions.

FIG. 3 is a cross-sectional view taken along the lines 3-3 of FIG. 1. The view is broken away to show adjacent portions of the first pair of rotor blades 16*a*, 16*b* and the interblade chamber 70 therebetween which receives cooling air under operative conditions. The first seal member 72*ab* is shown adjacent the upstream ends 62 of the rotor blades 16*a*, 16*b* and the second seal member 72*abd* is shown adjacent the downstream end 64 of the rotor blade.

As shown in FIG. 2 and FIG. 3, sidewalls bound the channels. For example, a first sidewall 76 extends longitudinally in the neck of the rotor blade. The first sidewall extends into the rotor blade in the circumferential direction to form a seal surface 84 on the neck 36. As shown in FIG. 3, this seal surface is engaged by the seal member 72*ab*.

As shown in FIG. 2 and FIG. 3, the first sidewall 76 has an outer end 78 and an inner end 82. An outer endwall 86 extends from the first sidewall 76 at the outer end and faces inwardly in the radial direction. An inner endwall 88 extends from the first sidewall and is spaced radially from the outer endwall. The inner endwall faces outwardly in the radial direction toward the outer endwall. The first sidewall and the endwalls partially bound the seal channel 74 for receiving the seal member 72*ab*. A second sidewall 92 extends into the interblade chamber 70 and is spaced axially from the first sidewall at the outer end and at the inner end of the first sidewall. As shown in this embodiment, the second sidewall includes at least a first segment and a second segment which is spaced radially from the first segment. The first segment of the second sidewall is spaced axially from the first sidewall at the outer end of the first sidewall and the second segment of the second sidewall is spaced axially from the inner end of the first sidewall to bound the seal channel with the second sidewall at least at the outer end and the inner end of the first sidewall. Similarly, the downstream end 64 of the rotor blade 16*b* has a seal member 72*abd*, a seal channel 74*d*, a first sidewall 76*d*, a seal surface 84*d*, endwalls 86*d*, 88*d* and a second sidewall 92*d*.

Figure 2A:
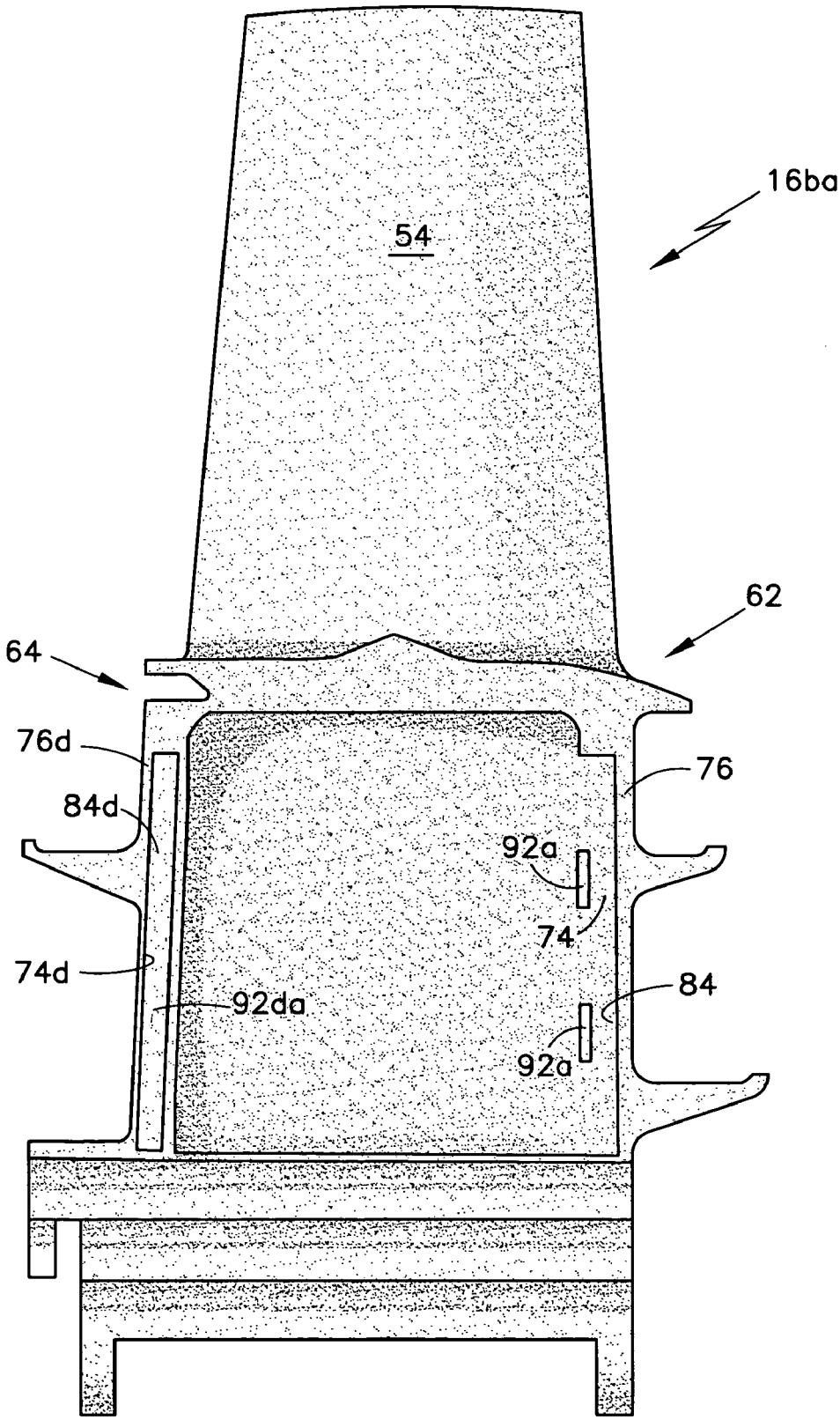
FIG. 2A is a side elevation view corresponding to the view shown in FIG. 2 of an alternate embodiment of the rotor assembly shown in FIG. 1 having at the downstream end of the rotor blade a first sidewall and a second sidewall bounding a seal channel that are of equal lengths and having at the upstream end a second sidewall formed of at least two sidewall segments bounding a seal channel.

FIG. 2A is a side elevation view corresponding to the view shown in FIG. 2 of an alternate embodiment 16*ba* of the rotor blade 16*b* shown in FIGS. 1-3. The seal members 72*ab* and 72*abd* of the rotor blade 16*ba* are broken away to show the seal channel 74 and the seal channel 74*d*. The alternate embodiment illustrates two different types of second sidewalls as represented by the second sidewall 92*a* and the second sidewall 92*ad*. As shown, the rotor blade at its downstream end 64 has the first sidewall 76*d* and the second sidewall 92*ad*. The second sidewall 92*da* is of equal length to the first sidewall 76*d*. The seal surface 84*d* extends on the first sidewall 76*d* as it does in Figs 1-3. The sidewalls bound the seal channel 74*d* for nearly the entire length of the neck. The rotor blade at its upstream end has the first sidewall 76 and a second sidewall which is formed of and represented by at least one sidewall segment 92*a* bounding the seal channel. In this particular embodiment, two sidewall segments are shown. The seal surface 84 extends on the first sidewall 76 as does the seal surface 84 on the first sidewall 76 shown for the rotor blade 16*b* shown in FIG. 2.

As shown in FIG. 3, the first sidewall 76 and the second sidewall 92 are at the upstream end 62 of the rotor blade 16*b*. The first sidewall and second sidewall extend circumferentially away from the adjacent portion of the first surface 66 into the rotor blade. The sidewalls are inwardly convergent in the circumferential direction. The seal member is resiliently deformable and is compressed against the sidewalls 76, 92 in the installed condition and under operative conditions. The seal member is sized to be forced inwardly and compressed by engagement with the second surface 68 of the adjacent rotor blade 16*a*. Thus, the second surface 68 of the adjacent rotor blade causes the seal member to be urged tightly against first sidewall because the second sidewall constrains the seal member to move in that direction. As a result, sealing contact occurs along the length of the seal member against the seal surface 84 of the first sidewall over at least substantially the entire length of the seal member. In the embodiment shown, the engagement was for the entire length of the seal member.

Figure 3A:
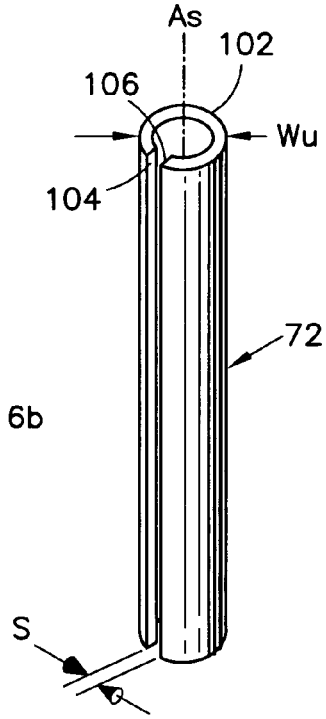
FIG. 3A is a perspective view of a seal member of the present invention.

FIG. 3A is a perspective view of one embodiment of the resilient seal member 72 of the present invention in the uninstalled condition. The seal member has an annular wall 102 extending circumferentially about an axis As of the seal member. The annular wall is laterally (or circumferentially) interrupted by a lateral gap S. The gap S extends longitudinally with respect to the axis As to form a first longitudinally extending end 104 and a second longitudinally extending end 106 that are separated by the gap S. The ends are movable with respect to each other; that is, inwardly in response to a compressive force on the annular wall and outwardly in response to thermal expansion of the annular wall. Accordingly, the seal member is hollow and has a generally cylindrical cross-sectional shape. In this particular embodiment, the seal member has a C-shaped cross-sectional shape having an uninstalled width Wu.

The seal member is formed of a high temperature material that is suitable for use at the high temperatures of the turbine section of a gas turbine engine and that is both deformable and resilient at such high temperatures. High temperatures are temperatures in excess of about one thousand degrees Fahrenheit (1000° F.) or about 600 degrees Celsius (600° C.). Such a material is referred to herein as a "high temperature material." The material has strength and toughness, and is preferably corrosion resistant and oxidation resistant at such temperatures. Such materials are typically alloys and one particular family of alloys are nickel based super alloys such as the Inconel® family of materials provided by the Special Metals Corporation. One particular alloy known to be suitable is described as Aerospace Material Specification (AMS) 5599 material. An example of such material is Inconel® 625 material.

Figure 4A:
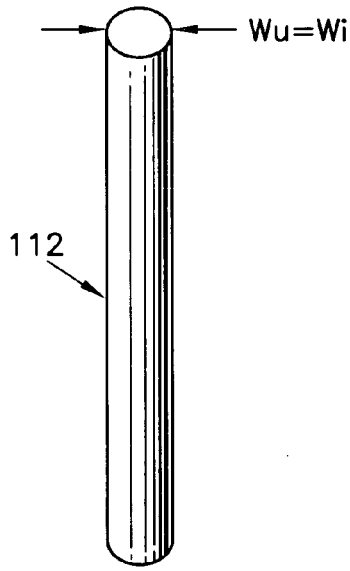
FIG. 4 is a cross-sectional view corresponding to the view shown in FIG. 4 of a prior art construction having a seal pin which is solid in form.
Figure 4:
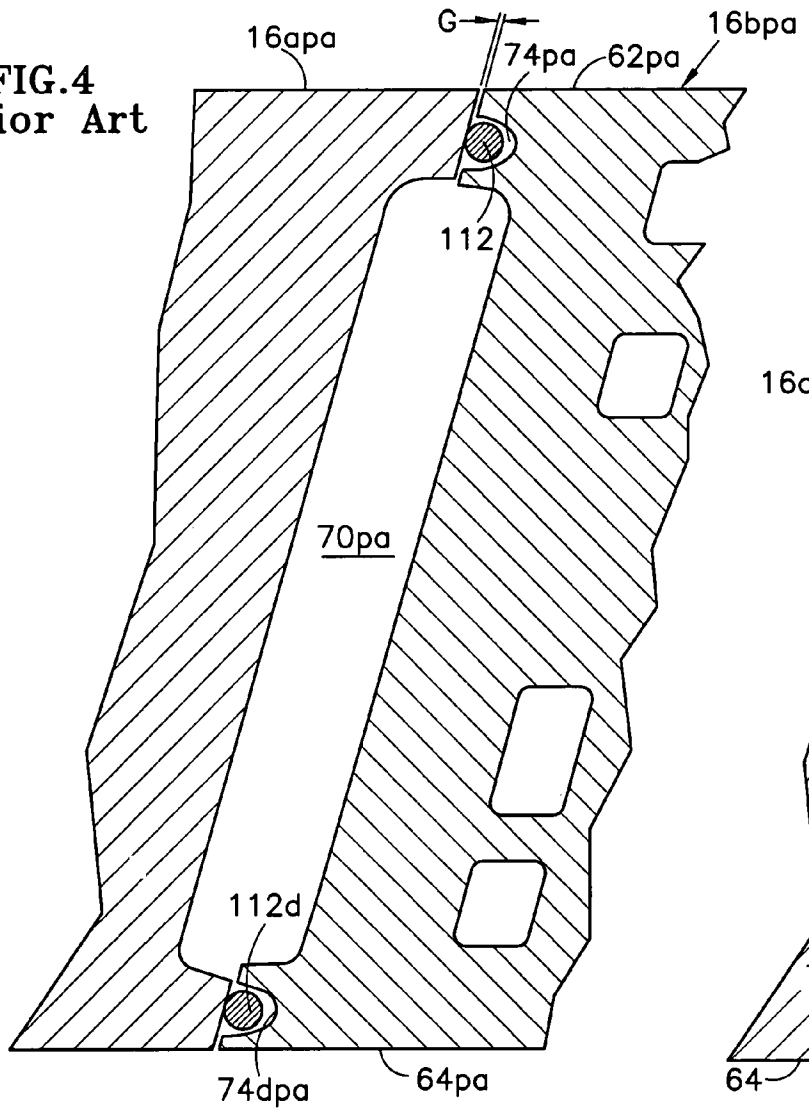
FIG.4 Prior Art

FIG. 4 is a cross-sectional view of a prior art construction having a seal channel 74*pa* adjacent the gap G that loosely contains a solid seal pin 112. The view corresponds to the view shown in FIG. 3 which was taken along the lines 3-3 of FIG. 1. The view is broken away to show adjacent portions of the first pair of rotor blades 16*apa*, 16*bpa* and the interblade chamber 70*pa* therebetween which receives cooling air under operative conditions. FIG. 4A shows the solid seal pin 112 of the prior art construction and corresponds to FIG. 3A. The pin has an uninstalled lateral width Wu and an installed lateral width Wi that is equal to the lateral width Wu. The seal channel 74*pa* extends in a generally radial direction at the upstream end 62*pa* of the rotor blade 16*bpa*. Similarly, the seal channel 74*dpa* extends adjacent the downstream end 64*pa* of the rotor blades and receive solid seal pin 112*d*.

The solid seal pin 112 is disposed in the seal channel 74*pa* to help block the flow of unwanted gases, such as working medium gases or cooling air, through the gap G. The pins are also formed of a material that can withstand the elevated temperatures the pin encounters under operative conditions. The pins are sized considerably smaller than the seal channel in order to permit assembly of the rotor blades 16*apa*, 16*bpa* and pins 112, 112*d* to the rotor disk while accommodating tolerance variations in these parts.

Accordingly, the pin 112 only partially blocks the leak path for gases through the gap G. The pin cannot be made with the same lateral width Wu to improve sealing as has the resilient seal member 72 for many reasons. For example, with a solid seal pin nearly as large in lateral width as the resilient seal member 72, the variations in tolerances between adjacent parts would cause difficulty during assembly and might even prevent assembly. In addition, even with a smaller size pin than the seal member 72 forced into place, the rotor blades 16*apa*, 16*bpa* would likely bind during operation due to thermal expansion of the rotor blades and thermal expansion of the pins as heat is transferred from the hot working medium gases to these parts. As will be realized, a pin of the same size as the resilient seal member 72*ab* could not be assembled using parts that did not have tolerance variations.

Figure 5:
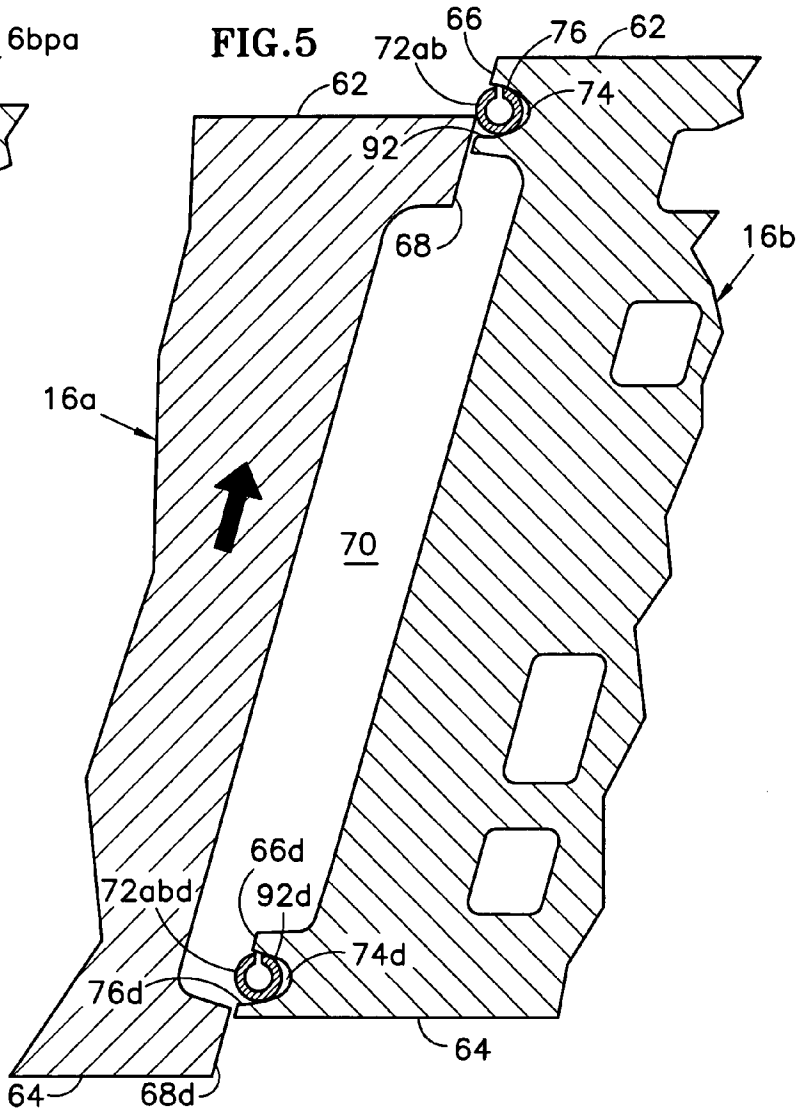
FIG. 5 is a cross-sectional view corresponding to the view shown in FIG. 3 and broken away to show adjacent portions of a first pair of rotor blades during assembly as the adjacent first rotor blade is slid into position just prior to compressing the seal member.
Figure 6:
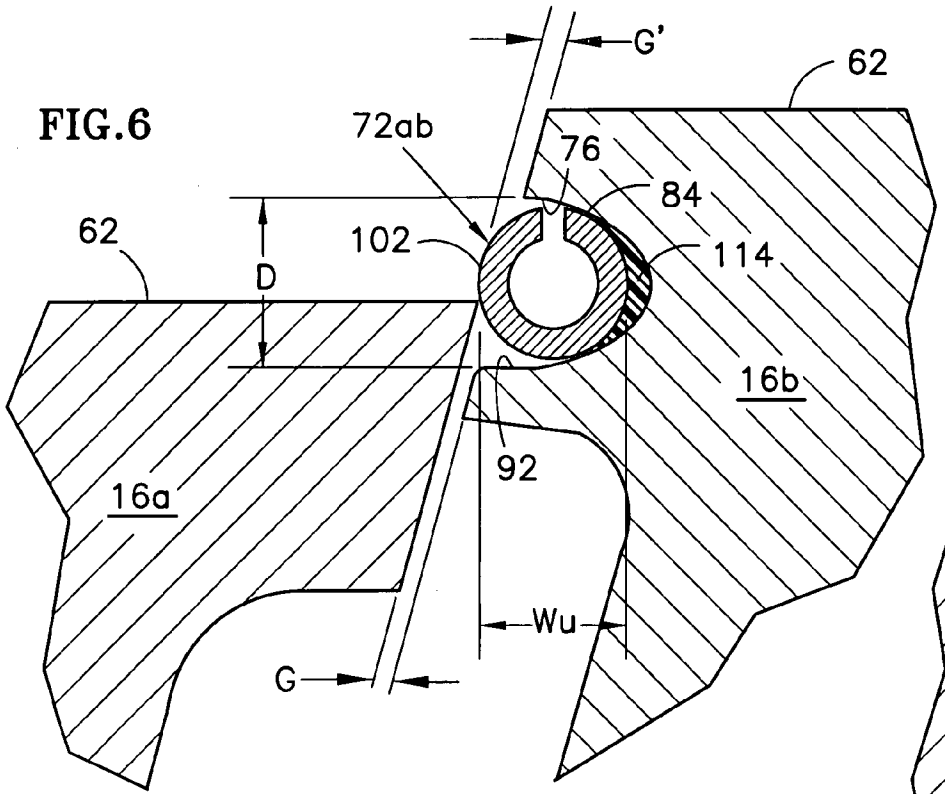
FIG. 6 is an enlarged cross-sectional view of a portion of the cross-sectional view shown in FIG. 5 at the upstream end of the rotor blade during assembly showing the seal member held in place by an elastomeric-like potting material prior to engagement with the adjacent rotor blade.
Figure 7:
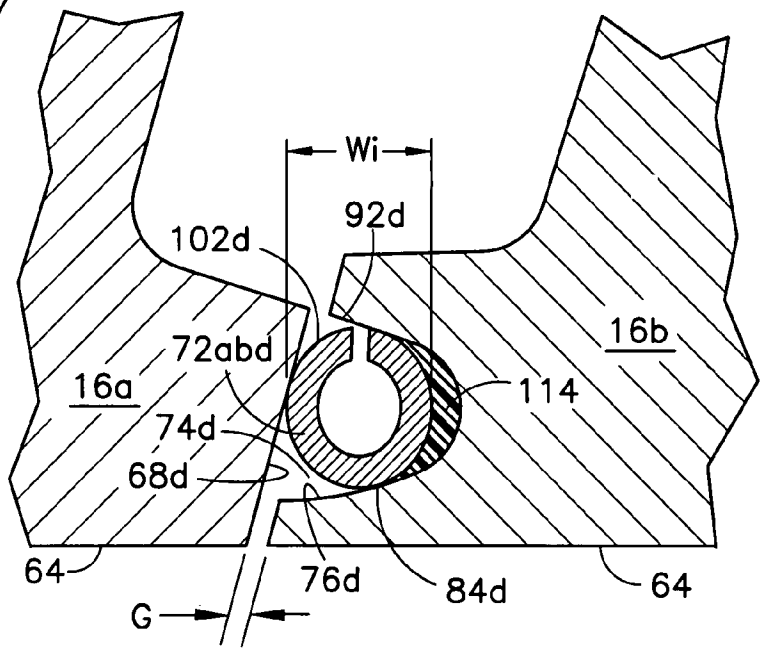
FIG. 7 is an enlarged cross-sectional view of a portion of the cross-sectional view shown in FIG. 3 at the downstream end of the rotor blade after completion of assembly.

The method of forming the rotor assembly is explained by referring to FIG. 1 and FIG. 3 as discussed above and by referring to FIG. 5, FIG. 6 and FIG. 7 as discussed below. FIG. 5 is a view during assembly corresponding to the view shown in FIG. 3 and shows adjacent portions of a first pair of rotor blades 16*a*, 16*b*. FIG. 6 is an enlarged view during assembly at the upstream end 62 of the rotor blades 16*a*, 16*b* of part of the view shown in FIG. 5. FIG. 7 is an enlarged view, after completing assembly, at the downstream end of the rotor blade of part of the view shown in FIG. 3.

As shown in FIG. 1, the method of assembling the parts includes disposing the first rotor blade 16*b* in a corresponding slot 24*b* in the rotor disk. As shown in FIG. 5, the first rotor blade 16*b* has the seal channel 74 formed in the neck of the rotor blade for receiving and positioning the seal member 72*ab*. The method includes disposing the seal member 72*ab* in its seal channel 74 between the first sidewall 76 and the second sidewall 92 at the upstream end 62; and, in a similar fashion, disposing the seal member 72*abd* between sidewalls 76*d*, 92*d* at the downstream end 64 of the rotor blade 16*b*.

Each seal member 72*ab*, 72*abd* is held in place in the associated seal channel 74, 74*d* with an appropriate material prior to disposing the second rotor blade 16*a* in its installed position in the rotor disk 14. The material 114 is shown in FIG. 6 and FIG. 7 and is broken away in FIG. 5 for clarity. In this particular embodiment, the seal members are held in place during assembly by disposing a potting material 114 in the seal channel. One satisfactory material is thought to be General Electric RTV 102 Silicone Material, available from the General Electric Company, Schenectady, N.Y. which was used in assembling the prior art configuration shown in FIG. 4.

Prior to engagement with the adjacent rotor blade 16*a*, the silicone potting material 114 is disposed in the channel 74, 74*d*. The silicone material extends from the seal member to the first rotor blade 16*b* to hold the seal member in place. As assembly takes place, the silicone potting material accommodates movement of each seal member 72*ab*, 72*abd* and retains the seal member in place as the seal member is compressed and expands during assembly. For example, the silicone potting material maintains contact with the seal member as the adjacent second rotor blade 16*a* is slid into position prior to compressing the seal members. The potting material is easily displaced but continues to maintain contact as the first rotor blade 16*b* engages the seal members with the sidewalls 92, 92*d* and then aids the second rotor blades 16*a* in compressing the seal member.

As shown in FIG. 1 in combination with FIG. 5, FIG. 6 and FIG. 7, the method includes disposing the second rotor blade 16*a* in the adjacent slot 24*a* of the rotor disk by sliding the second rotor blade into the adjacent slot. As the second rotor blade 16*a* is slid into the adjacent slot, the second rotor blade will engage the annular wall 102*d* of the downstream seal member 72*abd*. The seal member 72*abd* is engaged first, by the upstream end 62 of the second rotor blade 16*a*, and, then by the second surface 68 of rotor blade 16*a*. As the second rotor blade 16*a* moves toward the installed position, the second surface forces the seal member 72*abd* into the seal channel 74*d*, compressing the seal member.

As shown in FIG. 5, the second surface 68 at the upstream end 62 passes by the channel 74*d*. The seal member 72*abd* moves back to the position it had prior to engaging the second surface 68 of the second rotor blade. Similarly, as the second surface reaches the upstream end 62, the second surface 68 gradually increases the compressive force that the second rotor blade 16*a* exerts on the seal member 72*ab*. This occurs over at least a portion of the movement of the second rotor blade into the adjacent slot 24 until the second surface extends over the seal member. This causes the maximum deflection of the seal member with the second surface urging the seal member against the first and second sidewalls 76, 92. In a like manner, the second surface 68*d* at the downstream end 64 engages the seal member 72*abd* and drives the seal member into the sidewalls 76*d*, 92*d*.

As shown in FIG. 6, the second sidewall 92 of the first rotor blade 16*b* is spaced axially by a distance D from the first sidewall 76. The axial distance D between sidewalls decreases as the sidewalls extend circumferentially into the rotor blade away from the adjacent portion of the first surface 66. As can be seen in FIG. 5 and FIG. 6, the seal member has a circumferential or lateral width Wu prior to installation of the seal member and, even though retained in the channel 74, has a lateral width Wu prior to installing the second rotor blade 16*a* in the rotor disk 14. The uninstalled width Wu is greater than the width Wi in the installed condition such that, prior to installation of the adjacent second rotor blade 16*a*, the seal member engaging the sidewalls will extend circumferentially (that is, laterally with respect to the axis Ar) past the first surface of the rotor blade by a lateral distance G'. The distance G' is greater than the circumferential gap G that exists upon installation between the adjacent portion of the first surface 66 of the first rotor blade 16*b* and the second surface 68 of the second blade 16*a*.

As discussed above and as shown in FIG. 3 and FIG. 7, the seal member 72*abd* is formed of high-temperature material and is deformably resilient. The seal member 72*abd* in the installed condition is disposed between the pair of adjacent rotor blades in the seal channel 74*d* and extends across the gap G between the root sections 26 of the adjacent pair of rotor blades 16*a*, 16*b*. The seal member is engaged by the second sidewall 92*d* of the first rotor blade 16*b* to trap the seal member during installation and under operative conditions. The second sidewall holds the seal member in place as the seal member is resiliently compressed by the second surface 68*d* of the second rotor blade 16*a*. Thus, the second sidewall urges the seal member into sealing engagement with the seal surface 84 on the sidewall 76*d* of the first rotor blade and into sealing engagement with the second surface 68 of the adjacent second rotor blade in response to the forces exerted by the second rotor blade 16*a*.

During operation of the gas turbine engine 10, working medium gases are flowed along the annular flowpath 18 that extends through the rotor assembly 12. Heat from the hot working medium gases quickly vaporize the silicone potting material that is disposed in the seal channel 74 to retain the seal members 72 during assembly.

The hot, high pressurized gases exert forces on the rotor blades as the gases are flowed through the airfoil sections 32 of the rotor blades 16. The forces drive the rotor assembly about the axis of rotation Ar. The rotor blades are urged outwardly with respect to the rotor disk by rotation of the rotor disk and exert rotational forces against the disk. The rotational forces are opposed by forces acting through the surfaces of the rotor disk bounding the slots 24 that engage the rotor blades. Thus, the rotor disk restrains the rotor blades against further outward movement. The rotor blades rock slightly back and forth in the circumferential direction because of tolerances on the parts in combination with variations in forces exerted by the working medium gases and variations in the rotational forces acting on the rotor blades.

The seal members 72 press against the adjacent rotor blades 16 with a sealing force under operative and non-operative conditions of the rotary machine. For example, the seal members 72*bc*, 72*ae* of the second pair of flanking rotor blades 16*c*, 16*e* each exert a force that urges the first pair of rotor blades 16*a*, 16*b* toward each other and against the first seal member 72*ab*. Likewise the sealing force of the first seal member 72*ab* acts against and through the first pair of rotor blades 16*a*, 16*b* to urge the second seal members 72*bc*, 72*ae* against the second pair of rotor blades 16*c*, 16*e*. These forces result in a frictional force opposing movement of the rotor blades as the components move in sliding engagement with respect to each other as a result of vibrations and rocking of the rotor blades under operative conditions. The frictional forces provide coulomb damping of vibrations in the rotor disk and the rotor blades. The durability of the rotor assembly is enhanced because damping vibrations decreases vibrational stresses in the rotor blades and rotor disk.

The resilient seal members 72 exert sealing forces at the root sections 26 of adjacent rotor blades 16 and extend to block the flow of unwanted gases between the adjacent rotor blades. This increases the level of the efficiency of the rotary machine 10 as compared to machines which do not block the flow of these gases to the extent of the present invention. Under operative conditions, the seal members remain in engagement with the adjacent rotor blades by reason of being compressed. The level of compression is great enough so that this occurs even as the rotor blades rock back and forth or as the rotor blades move outwardly in response to operative forces or change in dimension as a result of thermal expansion.

Thermal expansion of the rotor blades 16 and the seal members 72 also increases the sealing forces which further aids in damping and blocking the flow of unwanted gases between the root sections 26 of the rotor blades. As noted above, the gases might be working medium gases for constructions in which the cavity 70 between the rotor blades is not pressurized with cooling air; or, the gases might be cooling air lost to the working medium flow path by flowing away from the cavity in constructions using the cavity as a supply region for cooling air.

The seal member has a satisfactory level of durability which results from the design of the seal member employing high temperature material that allows the seal member to accommodate thermal expansion of the adjacent rotor blades without permanently deforming or being crushed by movement of the rotor blades under operative conditions. In addition, the seal members provide satisfactory sealing forces under operative conditions while resiliently deflecting to accommodate installation of the rotor blades in the rotor disk.

Although the invention has been shown and described with respect to detailed embodiments thereof, it should be understood by those skilled in the art that various changes in form and detail may be made without departing from the spirit and scope of the claimed invention.

We claim:

1. A rotor assembly for a rotary machine having a rotor disk which extends circumferentially about an axis of rotation (Ar) and which includes a plurality of circumferentially spaced slots in the rotor disk that adapt the rotor disk to receive an array of rotor blades, each rotor blade having a root section, a platform section, and an airfoil section extending outwardly with respect to the root section, the root section having a blade root for engaging an associated slot in the rotor disk, and a neck extending radially outwardly with respect to the blade root toward the airfoil section, which comprises:

a pair of said adjacent rotor blades which are spaced apart leaving an interblade chamber therebetween which is bounded in part by the root section of each rotor blade, each rotor blade having a pressure side and a suction side, a first surface which extends in the neck and which faces circumferentially on one of said sides, and a second surface on the other of said sides which extends in the neck and which faces circumferentially, the first surface of at least one of said pair of rotor blades being spaced from the associated second surface on the adjacent rotor blade leaving a circumferential gap (G) therebetween which is adjacent to the interblade chamber over at least a portion of the radial extent of the root section, at least one of the pair of rotor blades having a first sidewall which extends in a generally radial direction in the neck of the rotor blade and which extends into the rotor blade in the circumferential direction away from the first surface bounding the gap (G), the first sidewall having a seal surface, an outer end and an inner end, a second sidewall having at least a first segment and a second segment which is spaced radially from the first segment, the first segment and the second segment extending into the interblade chamber and being spaced axially from the first sidewall to bound a seal channel which extends therebetween, the seal channel extending in a generally radial direction in the neck of the rotor blade between the two sidewalls, the first and second sidewalls extending away from the adjacent portions of the first surface bounding the gap (G) into the rotor blade and being convergent inwardly in the circumferential direction;

a deformable seal member which is resilient, which is disposed in the seal channel and which is trapped by the segments of the second sidewall against the first sidewall, the seal member extending across the gap (G) between the root sections of the adjacent rotor blades and engaging the seal surface of the first sidewall of the first rotor blade and the second surface of the adjacent rotor blade in the installed condition by being held in place by the segments of the second sidewall as the seal member is resiliently compressed by the adjacent surface of the second rotor blade; the seal member being formed of a high temperature material and having a circumferential width (Wu) in the uninstalled condition of the adjacent rotor blade that is greater than circumferential width (Wi) in the installed condition of the adjacent rotor blade such that the seal member extends circumferentially past the adjacent portion of the first surface of the rotor blade by a distance (G') prior to installation of the adjacent rotor blade, the distance (G') being greater than the distance (G);

wherein compression of the resilient seal member between the pair of rotor blades causes the seal member to exert a sealing force against each of the first rotor blades which damps vibrations in the rotor blades while circumferentially urging the first rotor blades away from each other; and, wherein the engagement of the first sidewall and the second surface of the adjacent second rotor blade by the seal member with sealing force blocks leakage of the working medium gases between the necks under operative conditions.

2. The rotor assembly of claim 1 wherein the first segment of the second sidewall is spaced axially from the first sidewall at the outer end of the first sidewall and the second segment of the second sidewall is spaced axially from the inner end of the first sidewall to bound the seal channel with the second sidewall at least at the outer end and the inner end of the first sidewall.

3. The rotor assembly of claim 1 wherein the rotor assembly further includes an outer endwall extending from the outer end of the first sidewall which faces inwardly in the radial direction, and an inner endwall extending from the first sidewall which is spaced radially from the outer endwall and which faces outwardly in the radial direction toward the outer endwall, the endwalls radially bounding the seal channel for receiving the seal member.

4. The rotor assembly of claim 1 which further includes a second pair of rotor blades flanking the first pair of rotor blades and which further includes a pair of second seal members each disposed between and engaging one of said flanking rotor blades and its adjacent rotor blade from the first pair of rotor blades, the seal members of the second pair of rotor blades urging the first pair of rotor blades toward each other and against the first seal member while the sealing force of the first seal member acts against and through the first pair of rotor blades to urge the second seal member against the second pair of rotor blades.

5. The rotor assembly of claim 1 wherein each seal member has an annular wall extending circumferentially about an axis (As) of the seal member, and wherein the seal member has a generally cylindrical cross-sectional shape and wherein the annular wall of the seal member has a first spanwisely extending end and a second spanwisely extending end which is spaced circumferentially from the first spanwisely extending end leaving a gap (S) extending laterally therebetween, the seal member having a C-shaped cross sectional shape.

6. The rotor assembly of claim 1 wherein the seal member is formed of a spring-like material having a hollow cross-sectional shape formed by a single wall extending about an axis (As), the wall being laterally interrupted by a gap (S) which extends axially to form two ends which are movable with respect to each other in response to a compressive force and wherein the seal member is formed of AMS Specification 5599 material.

7. The rotor assembly of claim 1 wherein the rotor assembly has an upstream end and downstream end and the seal member extends in the root section adjacent to the upstream end of the rotor assembly.

8. The rotor assembly of claim 1 wherein the rotor assembly has an upstream end and downstream end and the seal member extends in the root section adjacent to the downstream end of the rotor assembly.

9. The rotor assembly of claim 1 wherein the rotor assembly has an upstream end and a downstream end and the seal member is a first seal member which extends in the root section adjacent to the upstream end of the rotor assembly and wherein the seal member includes a second seal member that extends in the root section adjacent to the downstream end of the rotor assembly.

10. A method of forming a rotor assembly for a rotary machine having a rotor disk which includes a plurality of circumferentially spaced slots in the rotor disk and an array of rotor blades, each rotor blade having a root section and an airfoil section extending outwardly with respect to the root section, the root section having a blade root for engaging a corresponding slot in the rotor disk, and a neck extending radially outwardly toward the airfoil section, the array of rotor blades including a first rotor blade and a second rotor blade that form a first pair of adjacent rotor blades, the first rotor blade and the second rotor blade being spaced apart leaving an interblade chamber therebetween which is bounded in part by the root section of each rotor blade, each having a root section separated by a gap (G) in the installed condition from the adjacent rotor blade, the gap (G) being adjacent to the interblade chamber, which comprises:

disposing the first rotor blade of the first pair of adjacent rotor blades in the corresponding slot in the rotor disk;

disposing the second rotor blade of the first pair of adjacent rotor blades in the corresponding slot in the rotor disk;

disposing a deformable, resilient seal member formed of a high temperature material which extends across the gap (G) between a portion of the root sections of the adjacent rotor blades which includes engaging the deformable seal member with each of the rotor blades for resiliently compressing the seal member with the adjacent rotor blades and exerting a sealing force against each of the rotor blades with the seal member while circumferentially urging the first rotor blades away from each other under operative conditions;

wherein the step of disposing a deformable resilient seal member in the rotor assembly includes forming a seal channel for receiving the seal member in the neck of one of said rotor blades, the seal channel extending in a generally radial direction and being bounded at least in part by a first sidewall which extends away from a first surface bounding the gap (G), the first sidewall having a seal surface, the seal channel being bounded by a second sidewall having at least a first segment and a second segment which is spaced radially from the first segment, the first segment and the second segment extending into the interblade chamber and being spaced axially from the first sidewall to bound the seal channel which extends therebetween, the seal channel extending in a generally radial direction in the neck of the rotor blade between the two sidewalls, the segments of the second sidewall extending away from the adjacent portion of the first surface bounding the gap (G) into the rotor blade and being convergent inwardly in the circumferential direction toward the first sidewall for urging the seal member against the seal surface of the first sidewall, the second sidewall being spaced axially by a distance (D) from the first sidewall which decreases as the sidewalls extend circumferentially in the rotor blade, and; further includes disposing the seal member in the seal channel for trapping the seal member, the seal member having a circumferential width Wu in the uninstalled condition of the second rotor blade that is greater than the width Wi in the installed condition such that the seal member engages the sidewalls and extends circumferentially past the first surface of the rotor blade by a distance (G)'prior to installation of the adjacent second blade, the distance (G)'being greater than the gap (G);

wherein the seal member in the installed condition between the pair of adjacent rotor blades extends across the gap (G) between the root sections of the adjacent pair of rotor blades and wherein the seal member engages the first sidewall of the first rotor blade and the second rotor blade.

11. The method of forming a rotor assembly of claim 10 which further includes disposing a second pair of rotor blades in the corresponding slots in the rotor disk, the second pair of rotor blades flanking the rotor blades of the first pair of adjacent rotor blades;

disposing a second seal member between each flanking rotor blade and its adjacent rotor blade from the first pair of rotor blades;

urging under operative and non-operative conditions, the first pair of rotor blades toward each other and against the first seal member between the first pair of rotor blades with the second seal members;

urging the second seal members against the second pair of rotor blades by exerting the sealing force of the first seal member against and through the first pair of rotor blades to the second seal members which in turn urges the second seal members against the second pair of rotor blades.

12. The method of forming a rotor assembly of claim 10 wherein the step of disposing a deformable seal member between the root sections includes disposing the seal member between the sidewalls of the first rotor blade prior to disposing the second rotor blade in the rotor disk in the installed position and retaining the seal member between the sidewalls by disposing an elastomeric-like material in the seal channel that extends from the seal member to the first rotor blade to hold a seal member in place.

13. The method of forming a rotor assembly of claim 10 wherein the second rotor blade has a second surface which faces the first surface of the first rotor blade to bound the gap (G) and wherein the step of disposing a deformable seal member between the first rotor blade and the second rotor blade of the pair of rotor blades includes disposing the seal member between the sidewalls of the first rotor blade and then disposing the second rotor blade in the adjacent slot of the rotor disk by sliding the second rotor blade into said adjacent slot, and, engaging the outer surface of the seal member with the second surface of the second rotor blade, moving the second rotor blade toward the installed condition of the second rotor blade, the second rotor blade increasing the compressive force that the second rotor blade exerts on the seal segment over a portion of the movement of the second rotor blade into said adjacent slot and decreasing the compressive force that the second rotor blade exerts on the seal segment over a further portion of the movement of the second rotor blade into said adjacent slot.

* * * * *